US010806313B2

(12) United States Patent
Garcia Vila

(10) Patent No.: US 10,806,313 B2
(45) Date of Patent: Oct. 20, 2020

(54) COMPACT SUCTION STATION

(71) Applicant: SISTEMAS DE ASPIRACION CENTRALIZADA DEL HOGAR, S.L., Alcorcon (Madrid) (ES)

(72) Inventor: Alejandro Garcia Vila, Madrid (ES)

(73) Assignee: SISTEMAS DE ASPIRACION CENTRALIZADA DEL HOGAR, S.L., Alcorcon (Madrid) (ES)

( * ) Notice: Subject to any disclaimer, the term of this patent is extended or adjusted under 35 U.S.C. 154(b) by 223 days.

(21) Appl. No.: 16/061,013

(22) PCT Filed: Dec. 15, 2015

(86) PCT No.: PCT/ES2015/070910
§ 371 (c)(1),
(2) Date: Jun. 11, 2018

(87) PCT Pub. No.: WO2017/103293
PCT Pub. Date: Jun. 22, 2017

(65) Prior Publication Data

US 2018/0360279 A1 Dec. 20, 2018

(51) Int. Cl.

| | |
|---|---|
| ***A47L 5/38*** | (2006.01) |
| ***A47L 9/14*** | (2006.01) |
| ***A47L 7/00*** | (2006.01) |
| ***A47L 9/00*** | (2006.01) |
| ***A47L 9/22*** | (2006.01) |

(Continued)

(52) U.S. Cl.
CPC ..... *A47L 5/38* (2013.01); *A47L 7/0047* (2013.01); *A47L 9/00* (2013.01); *A47L 9/1409* (2013.01); *A47L 9/1418* (2013.01); *A47L 9/1472* (2013.01); *A47L 9/1481* (2013.01); *A47L 9/22* (2013.01); *A47B 88/90* (2017.01); *A47B 2210/17* (2013.01); *A47L 9/106* (2013.01)

(58) Field of Classification Search
CPC ..... A47L 5/38; A47L 9/1472; A47L 9/1409; A47L 9/1481; A47L 7/0047; A47L 9/00; A47L 9/1418; A47L 9/22; A47L 9/106; A47B 88/90; A47B 2210/17
See application file for complete search history.

(56) References Cited

U.S. PATENT DOCUMENTS

2004/0172782 A1 9/2004 Smith et al.
2005/0241099 A1 11/2005 Malinen
(Continued)

FOREIGN PATENT DOCUMENTS

DE 10 2014 002 743 B3 9/2014

*Primary Examiner* — David Redding
(74) *Attorney, Agent, or Firm* — Ladas & Parry, LLP; Malcolm J. MacDonald

(57) ABSTRACT

The invention relates to a compact suction station, the structure of which allows it to be arranged in small compartments, such as the skirting board area of kitchen units, said station being protected by a dismountable outer casing in which, in the front part of the assembly, there is an extractable part corresponding to the container drawer, and in which, in the rear part, there is a suction intake for the dirty air from the pipes and the plurality of inlets, and the clean air extraction outlet, the interior of the station consisting of two compartments that communicate with each other, one of them being used for the insertion of the extractable drawer with the container bag and the other to house the motor, the extraction channel and various electronic components.

11 Claims, 5 Drawing Sheets

(51) Int. Cl.
*A47B 88/90* (2017.01)
*A47L 9/10* (2006.01)

(56) References Cited

U.S. PATENT DOCUMENTS

2006/0016042 A1 1/2006 Bruneau
2013/0291899 A1 11/2013 Fingleton et al.

COMPACT SUCTION STATION

OBJECT OF THE INVENTION

The present specification defines a compact suction station that is installable in small compartments, mainly intended for installation in skirting boards of kitchen units, which is equipped with a dust container drawer that can be easily extracted from the front, and that is also equipped with a reinforced structure that prevents deformation and guarantees the airtightness of the assembly.

The field of application of the invention is the cleaning and industrial cleaning devices sector, and more specifically, centralized suction systems or devices in homes.

BACKGROUND

In order to define the meaning of the concept of centralized suction, it can be said to be a cleaning method based on air circulation driven by a motor that moves the dirt particles present on the floor through a flexible tube to a collection container for said dirt.

Generally, as may be observed in the different registrations that belong to the state of the art, centralized suction systems consist of installing a suction station in a point in the house that is not used during the activities of daily life, such as the garage or storage room, and connecting it to a plurality of suction inlets that are distributed throughout the house by means of a network of conduits that are installed in the walls, suspended ceilings, floors, and other spaces in the house. To use this system, a hose must be connected to the inlets in the house and the system is activated automatically, without the need to go to the room where the station is located to turn it on, and the dust, mixed with air, is carried through the tubes to the suction station, where it is stored in the container until it is emptied. In this sense, in general, the capacity of this collection container is much larger than in any traditional vacuum cleaner, and it eliminates the need for inconvenient vacuum cleaner bags. Examples of this system are those defined in the registration U.S. Pat. No. 3,088,484 by G. W. Marsh, which defines a series of specific connections between the different inlets to the suction station; registration U.S. Pat. No. 7,406,744 by Marc Bruneau, which defines a centralized system also with multiple inlets and a station or container with a specific cooling system; registration U.S. Pat. No. 7,080,425 by H-P Products, which defines a specific suction station with different storage containers, but that also requires the previous connections to different inlets; registration F1842038 by Markuu Juhani, which defines a specific structure of inlets and conduits connected to a suction station; registration EP2679129 by Cube Investments Limited, with a more sophisticated system with controller circuits and even with information displays. All of these registrations have the definition of said centralized suction system in common, in other words, that a series of different inlets is required that reach a container, which may have different specific characteristics.

Continuing this analysis of the state of the art, it is important to note that there are also registrations that define only specific containers, such as the ones defined in registration KR101200037 with multiple hanging filters; registration US2014/0207939 by Elextrolux Home Care, with a computerized container and specific programmable circuits; or registration US2008/0115310 which also defines a container with a modular storage system. One aspect that all of these registrations have in common is that the required size of the container is very large, because it must generate the power necessary for the different inlets distributed throughout the home to be able to transport the dirt, and therefore these containers, as commented earlier, are installed in areas such as garages or storage rooms. Other examples of more or less outwardly similar forms are found in the registrations USD617962 and USD618408 by Electrolux Home Care, which are cylindrical with suction and extraction inlets and outlets at different heights.

There are also registrations that define specific inlets for the connection of hoses and conduits, such as the ones defined in registration ES2296562 by Sistemas de Aspiración Centralizada del Hogar; conduits with intermediate elements that improve the assembly, such as the one defined in registration CA2369390 by Alexandre Plomteux; or specific suction motors such as the one defined in registration WO03/075733 by Cube Investments Limited; or the one defined in registration U.S. Pat. No. 8,001,650 by Jerry Trotter, which discloses a suction station with automatic unloading, which allows us to forget about emptying the container, since the station is connected to the drain of the house, and after vacuuming, the station automatically discards all of the dirt that accumulated during the vacuuming process.

Of the examples available on the market and in the registrations considered to form part of the state of the art, it can be observed that this type of suction system is known, but they are characterized in that they differentiate between the inlets with their conduits, and the station or container, which generally has large dimensions due to the large amount of power required for the system to function correctly.

For this reason, the present invention incorporates a small, compact container that allows the necessary power to vacuum to be generated from the different inlets connected by pipes to said station, and that is also compact enough to not require large dimensions.

At this point, the existence of a registration, PCT/FI2003/000638 by Masala Timo Malinen, which could be considered to be the closest in the state of the art, should be noted. Said registration combines two utility models that separately define two inventions, which together are intended to define a compact suction station, which therefore requires pipes, seals, and joints that attach the assembly, not guaranteeing the airtightness of the assembly, and also defining a station that has a single suction point, and therefore cannot be integrated into a centralized suction network. Additionally, due to the problems of the dimensions and of defining a compact device, this registration defines stations that do not store the dirt, but rather that transport it by means of an outlet and pipe connected to an element outside of said station. For these reasons, even defining a compact device, the invention described below defines a suction station that differs from the previous one, given that it allows connection to a network of different inlets, allows dirt to be stored for later disposal, and also defines an airtight element.

Taking into account the preliminary analysis, it can be said that there are no small, compact devices that make it possible to incorporate in a single device the connection to a plurality of inlets, the container, and the suction system, including the motor, while at the same time allowing installation anywhere in the home, for example and preferably, in the skirting board zone of kitchen units, but also inside the kitchen unit on the right side or left side, hanging on the wall, or recessed into a wall.

For all of these reasons, the present invention constitutes a solution that is different from the configuration and characteristics of any type of centralized suction station, and introduces a totally innovative solution into the sector, allowing suction stations to be located in small compartments without a loss of power or their customary functions.

DESCRIPTION OF THE INVENTION

The present invention defines a compact suction station, whose structure enables it to be designed with small dimensions, which is mainly intended for installation in small compartments, and more specifically, intended for installation in the area of the skirting board of kitchen units, with the total height of said compact station within the range of between 10 and 20 cm, with the width and length varying depending on the needs of the compartment.

The station is a device with a parallelepiped shape, which is protected externally by a dismountable housing that has precisely that parallelepiped shape, which is divided into two main compartments, the compartment intended for the extractable container drawer, and the compartment intended for the encapsulation of the motor and clean air extraction system. Likewise, the device has a front part, through which the container drawer is extracted, and a rear part, where the suction intake is located for the dirty air from the pipes and the plurality of inlets, and the clean air outlet or extraction.

Focusing on the compartment intended to house the extractable container, as mentioned before, there is an air intake from the different inlets, which is in the rear of the device. Said opening or intake connects the pipes to the dust bag, which is in a drawer that can be extracted from the front of the device. The drawer itself is a perfectly sealed container, which connects to the dirty air intake by means of a central nipple and a toric seal. The drawer is an extractable and closed element intended for the removal and emptying of the dust contained in the dust bag. This can be opened by means of raising its top surface, which means that in order to ensure the correct airtightness of the box, a seal or magnets are required to ensure the closure of the top surface with the rest of the walls of the drawer. In turn, continuing with the need for airtightness, the extractable drawer has a filter at the dirty air intake, in the zone of the adjustment and attachment of the bag to the air intake. This filter causes all of the dirt to enter the dust bag. The dust bag is a conventional textile bag with a plurality of layers, generally five, and said bag is replaceable; therefore, it is replaced with a clean one with each use, only requiring that the drawer be extracted, the top cover opened, and the bag attachment system be opened. The extractable drawer must communicate with the other compartment of the station, in other words, where the motor and the air extraction system are located, so one of its sides has an air outlet that communicates the drawer and the air intake in the motor. This outlet has seals, also toric, to ensure said airtightness. In addition, on the opposite wall of the compartment, there are several springs that push the drawer against the wall of the air outlet. However, a safety filter is installed in the drawer in said connection zone, which ensures that no particles can enter from the drawer to the motor compartment, with this filter made of fiber and replaceable. In addition, two safety elements are required in the drawer; these are a safety and regulation valve, preferably located in the rear part, whose function is to take in air from the outside if a vacuum is created in the machine while it is operating; and there is also a safety tab or sensor in the rear part zone of the drawer compartment whose function is to ensure that the station functions when the extractable drawer is perfectly fitted and inserted in its compartment, and therefore has the function of opening or closing the circuit to allow the device to function or not. Lastly, it should be noted that the drawer has a reinforced structure that prevents it from deforming while the station is in operation; that the extraction and insertion of the drawer out of and into the station is by means of guides and/or wheels that allow said pushing movement; and that the front cover may have different finishes, colors, and shapes.

In addition, the compartment intended for encapsulation of the motor and the clean air extraction system is communicated with the compartment of the extractable drawer by means of the airtight lateral air outlet defined earlier. Said outlet, which also has, as mentioned before, a filter that ensures that no particles pass through said outlet, connects the drawer to the motor of the station. Said motor is encapsulated, in such a way that vibration is reduced and it serves as an element to reduce noise. In turn, the motor can be defined as a direct motor with conical stages, and is responsible for generating the power that enables the absorption of air with dust from the pipes coming from the different inlets in the station. In order to reduce the noise level of said motor, the compartment is equipped with a system to extract the air from said motor to the outside of the device, consisting of different screens that generate a zig-zag conduit in which the air loses pressure when it comes into contact with said screens and ultimately exits to the outside through the extraction opening. It should be noted that this compartment is where the electronics of said station are located, in other words, the electronic card of the station, the power switch, and the two plugs for power supply connection, as well as the startup or line plug. These elements are installed on the air extraction system, such that they allow ventilation of said components. In turn, the motor has a ventilation outlet or gratings, generally in the rear part, to prevent overheating.

Having defined the two principal compartments that make up the station, it is important to note that said station, although designed for installation in the bottom of kitchen units or in their skirting boards, may be installed in any other small compartment, and for this purpose, a series of attachment supports are defined, whose purpose is to guarantee the stability of said station in case of potential vibration or external stresses. In all cases, it must be defined that a plurality of adjustable rubber feet are installed on the base, preferably located on each one of the corners of the base, and whose function is to reduce the effects of vibration and keep the assembly stabilized. In addition, in view of its placement underneath kitchen units, skirting boards, or in small horizontally-configured compartments, an attachment support is defined, holding the top surface of the suction plant, and which has two adjustable feet on the ends that allow it to be attached and pressed to the bottom surface of a kitchen unit or compartment, all protected by a rubber sheet that does not cause defects in the station. Likewise, this can be done by means of a specific attachment hanger or support, installed on the lower part of the station, whose purpose is to install the station inside a kitchen unit on its right or left side, even vertically.

To complement the description that is being provided and in order to provide a better understanding of the characteristics of the invention, a set of drawings is included as an integral part of the description, in which the following elements have been represented for the purposes of illustration but not limitation:

FIG. 1 shows a free perspective representation of the compact suction station assembly with its front view.

FIG. 2 shows a free perspective representation of the suction station in the previous figure with its rear view.

FIG. 3 shows a free perspective representation of the compact suction station assembly if the upper housing is removed.

FIG. 4 shows an elevation view of the compact suction station in the previous figures with the representation of a cross-section A-A'.

FIG. 5 shows the exposed view of the cross-section A-A' in FIG. 3.

FIG. 6 is a free perspective representation of the extractable drawer with its front view.

FIG. 7 shows a free perspective representation of the extractable drawer in FIG. 6 with its rear view.

FIG. 8 is a free perspective representation of the extractable drawer with its top cover open.

DESCRIPTION OF THE DRAWINGS

These figures show how the suction station is protected by an outer casing (1'), which is dismountable. Specifically, FIG. 1 shows how the front part of the assembly has an extractable part that corresponds to the container drawer (2), with its front pull handle (27) for extraction. FIG. 2 shows the presence of the suction intake (3) with the dirty air coming from the pipes and the plurality of inlets, and the clean air extraction outlet (4). It should be noted that the assembly is supported on a series of adjustable rubber feet (11'), preferably positioned on each one of the corners of the base of the suction station (1).

Following the aforementioned figures, which represent exterior view of the station assembly.

But in order to better define the assembly of the suction station (1)

In FIG. 5, it is possible to observe how both compartments are perfectly distinct. Specifically, it can be observed how the drawer (2) is perfectly inserted into the compartment (10) intended for the drawer (2), with the central nipple (21) with its toric seal (22) perfectly fitted into the contact zone of the suction intake (3). In turn, it can be observed that the drawer (2) is connected to the other compartment (10') of the motor (5) by means of an air outlet (23) located in one side, with this outlet having seals to ensure airtightness, and likewise, an replaceable fiber safety filter (24) can also be observed located inside the drawer and ensuring that no particles can enter from the drawer (2) to the motor (5). On the opposite wall of the compartment (10), there are several springs (25) that push the drawer (2) against the wall of the air outlet (23), thus improving the airtightness of the connection. Lastly, the figure shows the safety and regulation valve (26), preferably located on the rear part of the drawer, and which draws air from the outside if the machine creates a vacuum while in operation.

FIG. 5 also shows how the connection between the two compartments (10 and 10') is by means of an opening (100) that communicates the air outlet (23) of the drawer (2) and the intake conduit (5') of the motor (5). The motor, as mentioned before, is encapsulated to improve the performance of the assembly, and it has an outlet conduit (5") to the air extraction channel (6), formed by different screens (60) that generate a zig-zag conduit in which the air loses pressure when it comes into contact with said screens and ultimately exits to the outside through the extraction outlet (4) or opening. Not shown in this figure, all of the electronic components of said station (1) previously defined in FIG. 3 would be on top of the air extraction channel (6) or system.

Lastly.

Figure 1:
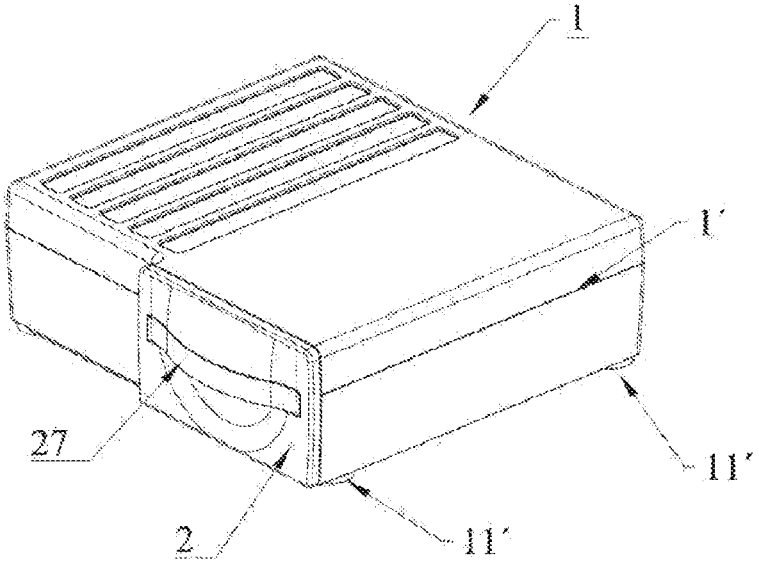
As shown in FIGS. 1 and 2, the present invention defines a compact suction station (1), whose structure, preferably a parallelepiped shape, can be installed in small compartments, such as the zone of the skirting boards of kitchen units. Specifically, a preferred embodiment of the invention would define a height of the assembly of 13 cm.
Figure 2:
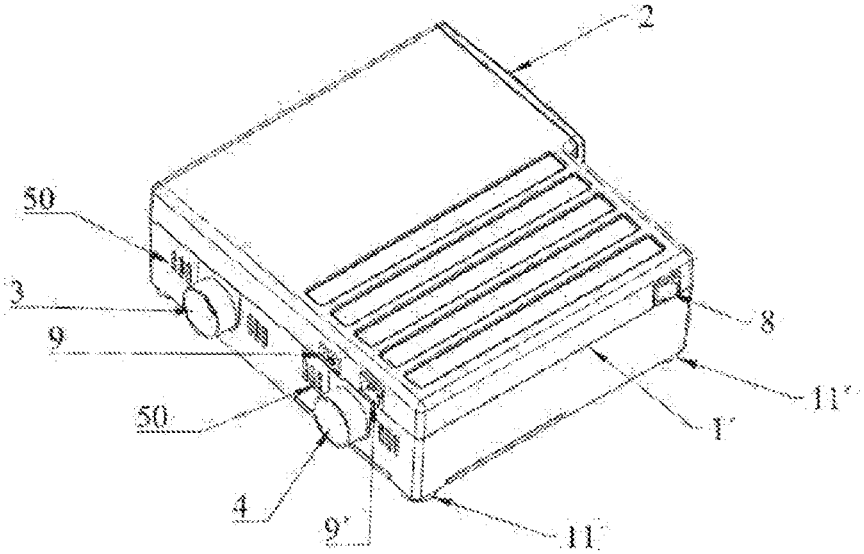
Figure 3:
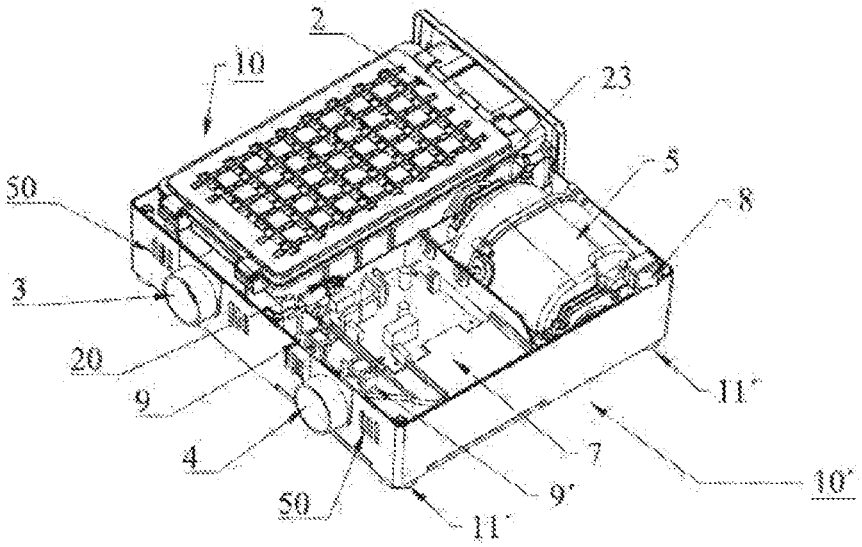
FIG. 3 shows the suction station (1) if the top part of the outer casing (1') is removed, therefore allowing the internal components to be seen. In this figure, it may be observed that the suction station (1) is divided into two principal compartments, the compartment (10') intended for the extractable container drawer (2) and the compartment (10') intended for the encapsulation of the motor (5) and the clean air extraction channel (6) or system. In this figure, it can be observed that it is in the motor compartment (10') where the electronic elements of said station are located, in other words, the electronic card (7) of the station, the power switch (8), and the two plugs for the electrical power supply plug (9) as well as the startup or line plug (9'). These elements are installed on the air extraction channel (6) or system, which is visible in later figures. This configuration allows the ventilation of said components. On the rear of the compartment (10) intended for the drawer (2), the safety sensor or tab (20) is visible, whose function is to ensure that the station (1) functions when the extractable drawer (2) is perfectly fitted and inserted into its compartment, and therefore to open or close the circuit to allow the device to function or not. In turn, the assembly has a series of ventilation outlets or grates (50), generally in the rear part, to prevent overheating. Lastly, the connection zone between the drawer (2) and its air outlet (23) and the motor (5) is also visible.
Figure 4:
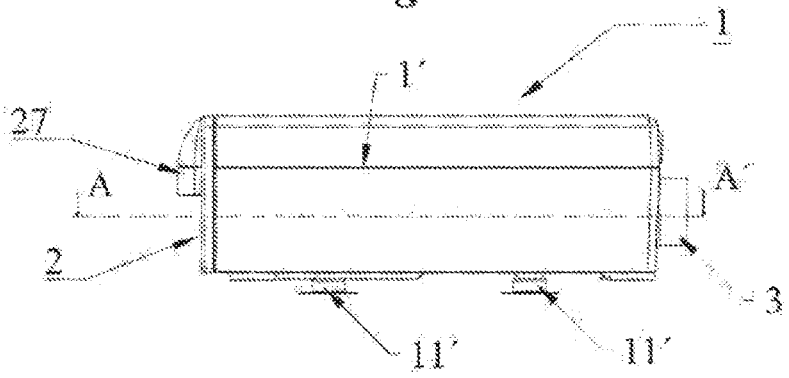
FIGS. 4 and 5 are described, with FIG. 4 showing an elevation view of the suction station (1) to which a cross-section A-A' is applied, which may be seen in FIG. 5 as if it were a plan view of the station after said cross-section has been made.
Figure 5:
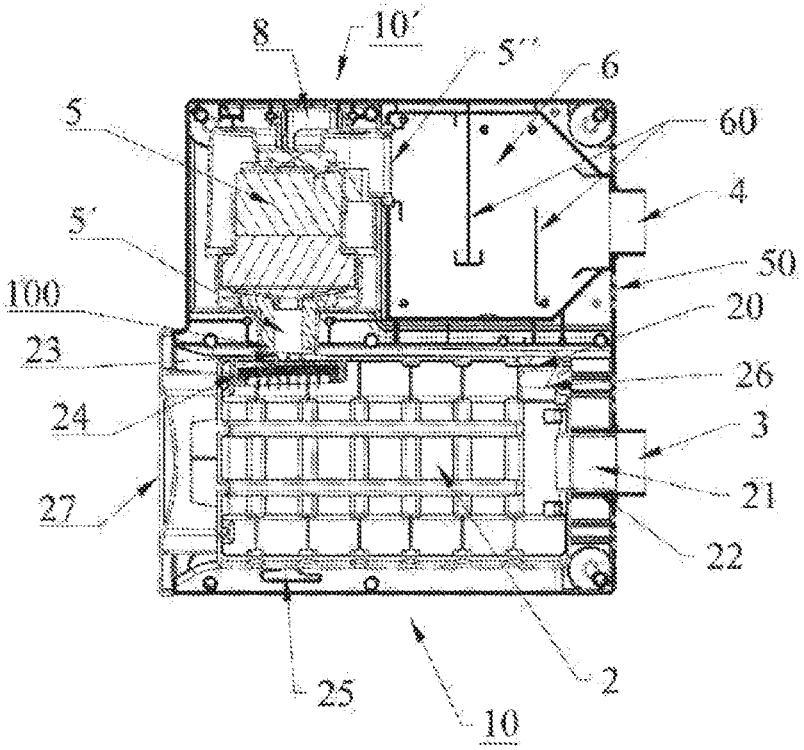
Figure 6:
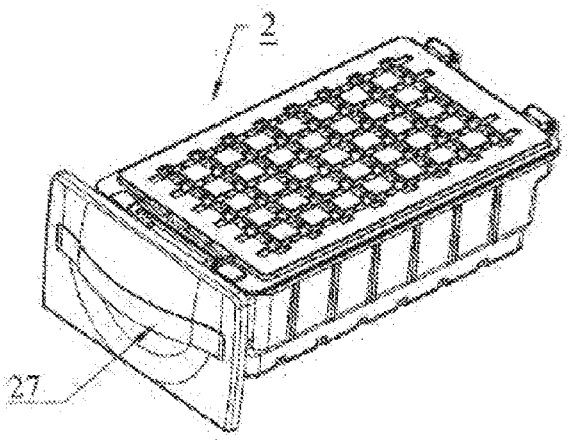
FIGS. 6 and 7 show how the extractable container drawer (2) has a reinforced structure, with a pull handle (27) on its front part and a central nipple (21) with its toric seal (22) in the contact zone with the suction intake (3) at the rear part. In this rear part, the safety and regulation valve (26) defined previously can be observed, and also that its side has the air outlet (23) for connection to the motor (5) and its seal (230) that ensures airtightness.
Figure 7:
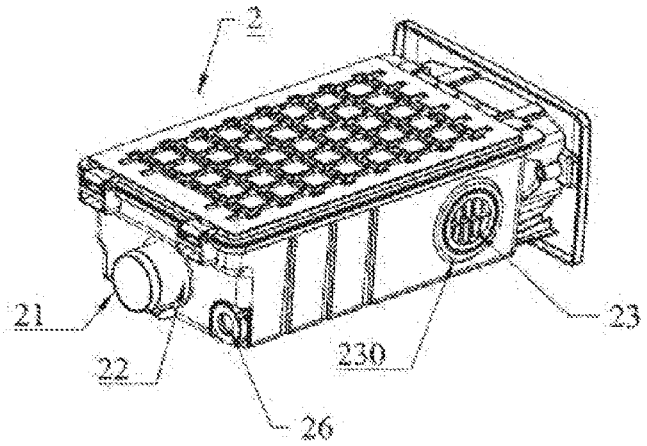
Figure 8:
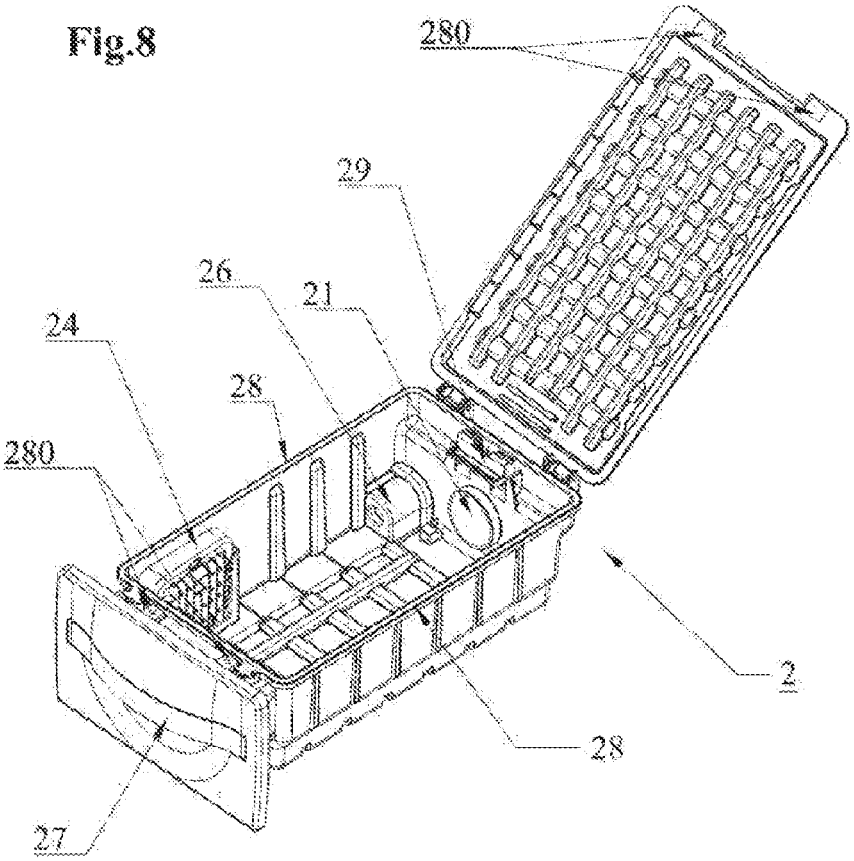
FIG. 8 shows the inside of the container drawer (2), which, as may be observed, can be opened by means of raising its top surface, which means that in order to ensure the correct airtightness of the box, a perimeter seal (28) and magnets (280) are required to ensure the closure of the top surface with the rest of the walls of the drawer. The replaceable fiber safety filter (24) can be observed inside and on one of the sides. It should be noted that the bag is not shown in the figure; however, the bag attachment system (29) is shown, which is located in the contact zone of the suction intake (3) and the central nipple (21), being in this case a clip system. As defined earlier, the dust bag is a conventional textile bag with a plurality of layers, generally five, and said bag is replaceable; therefore, it is replaced with a clean one with each use, only requiring that the drawer (2) be extracted, the top cover opened, and the bag attachment system (29) be opened.

Having sufficiently described the nature of the invention above, taking into account that the terms that have been used in this specification must be taken in their broad sense and not as limitations, as well as the description of the method of putting it into practice, and having demonstrated that it constitutes a positive technical advance, the registration is therefore requested, with the essence of the aforementioned invention constituted as specified below in the following claims.

The invention claimed is:

1. A compact suction station, protected externally by a dismountable housing, that is supported on a plurality of adjustable feet, with a suction intake for the dirty air from the pipes and the plurality of inlets distributed at different points in the home, and with a clean air outlet or extraction, wherein an interior of said station has a total height within the range of 10 to 20 cm, is made up of two principal compartments that communicate with each other by means of an opening, with one of these being the compartment used to house a container drawer with a reinforced structure that incorporates a replaceable dust bag made of a textile material, with said container drawer being extractable from the front of the suction station by means of a pull handle and which can be opened by raising its top surface, with said compartment having several springs that push the drawer against the wall that separates the two compartments, and that has a safety and activation sensor or tab on the rear part that is activated when the drawer is fitted in the compartment; and with the other compartment used to house the motor, an air extraction channel, the electronic card of the station, the power switch, the electrical power supply plug, and the startup or line plug; and with the station having a plurality of ventilation grates.

2. The compact suction station according to claim 1, wherein the container drawer comprises a central nipple with a toric seal that fits in a contact zone of the suction intake, in a rear part of the suction intake.

3. The compact suction station according to claim 1, wherein the container drawer comprises an air outlet with airtight seals on one side, with said outlet facing the opening.

4. The compact suction station according to claim 3, wherein the container drawer comprises a replaceable fiber safety filter located in a zone of the air outlet.

5. The compact suction station according to claim 1, wherein a rear part of the container drawer comprises a safety and regulation valve that is activated if a vacuum is created in the station.

6. The compact suction station according to claim 1, wherein the extractable container drawer comprises a perimeter seal and magnets that ensure the closure of the top surface with the rest of the walls of the drawer.

7. The compact suction station according to claim 2, wherein the container drawer comprises an attachment system by means of clipping the bag, which is located in the contact zone of the suction intake and the central nipple.

8. The compact suction station according to claim 7, wherein the attachment system comprises a filter located in the contact zone between the central nipple and the bag.

9. The compact suction station according to claim 1, wherein the motor comprises an intake conduit facing the opening, and an outlet conduit to the extraction channel.

10. The compact suction station according to claim 1, wherein the extraction channel comprises a plurality of screens that create a zig-zag conduit.

11. The compact suction station according to claim 1, wherein a top part of the dismountable housing is secured and pressed against the bottom surface of a kitchen unit or compartment by means of an attachment support comprising a sheet of rubber in the contact zone and two adjustable legs at ends of the attachment support.

* * * * *